US006969119B1

(12) United States Patent
Jennings

(10) Patent No.: US 6,969,119 B1
(45) Date of Patent: Nov. 29, 2005

(54) FOOTSTOOL

(76) Inventor: E. Carroll Jennings, 6617 Ivystone Dr., Jamestown, NC (US) 27282

( * ) Notice: Subject to any disclaimer, the term of this patent is extended or adjusted under 35 U.S.C. 154(b) by 0 days.

(21) Appl. No.: 10/973,791

(22) Filed: Oct. 26, 2004

(51) Int. Cl.[7] ..... A47C 31/10
(52) U.S. Cl. ..... 297/423.41; 297/119; 297/219.1; 297/228.12
(58) Field of Search ..... 297/119, 219.1, 297/228.12, 440.1, 423.41, 440.11

(56) References Cited

U.S. PATENT DOCUMENTS

| | | | | | |
|---|---|---|---|---|---|
| 2,612,942 | A | * | 10/1952 | Simjian | 297/461 |
| 3,205,010 | A | * | 9/1965 | Schick | 297/452.36 |
| 3,393,940 | A | * | 7/1968 | Ellsworth et al. | 297/423.41 |
| 3,667,803 | A | * | 6/1972 | Ford | 267/423.44 |
| 5,426,801 | A | * | 6/1995 | Klearman et al. | 5/652 |
| 5,466,041 | A | | 11/1995 | Hoffman et al. | 297/188.1 |
| 6,113,182 | A | * | 9/2000 | Wise | 297/423.41 |
| 6,155,637 | A | * | 12/2000 | Waters | 297/188.01 |
| 6,435,305 | B1 | * | 8/2002 | Ward | 297/423.41 |

OTHER PUBLICATIONS

Advertisement from Bed Bath & Beyond; Jul. 2004; p. 8; storage ottoman with wheels.
One page entitled "Pillow Fashions" showing various shaped pillows with descriptions.
One page printout from JC Penney website showing a "Faux Leather Storage Ottoman" dated Sep. 2003.
One page printout from Sunland Home Decor website showing a "Custom Steel Frame Upholstered Ottoman"; dated Oct. 2004.
One page advertisement from Fields.com showing a : "Faux-Mink Storage Cube"; 2004.
One page advertisement from Pottery Barn showing a "Maxime Cube" or slip cover ottoman; 2004.
One page advertisement from Front Gate showing a "Silk Ottoman with Storage"; 2004.
One page advertisement from Pottery Barn showing an ottoman; 2004.
One page advertisement from www.dwr.com showing a "Nexus Storage Cube"; 2004.
One page advertisement from Bombay Kids showing a "Grayson Airplane Cube"; 2004.
Two page printout from Living in Comfort website showing a "LA Baby Metal Glider Rocker and Ottoman"; dated Oct. 2004.
One page printout from Kids Palace website showing a "Dutailier 17301 Metal Ottoman", dated Oct. 2004.
One page advertisement from LumiSource, Inc. showing various ottomans; as seen in Home Decor Buyer magazine dated Apr. 2004.

* cited by examiner

*Primary Examiner*—Peter R. Brown

(57) ABSTRACT

A footstool is provided having outer pockets for storage of magazines, newspapers or the like. Additional storage space is available when the cushion is removed to expose an internal compartment having a shelf. The cushion includes a bottom pocket with a stiffener therein. The cushion can be removed and inverted into a bottom-up posture to provide a rigid writing or work surface. The stiffener can be removed from the cushion pocket and placed on the frame to function as a work table whereby the cushion may be used either as a pillow or simply placed atop the stiffener for use as a footstool.

10 Claims, 7 Drawing Sheets

FOOTSTOOL

FIELD OF THE INVENTION

The invention herein pertains to footstools as are conventionally used with upholstered chairs and sofas and particularly pertains to a footstool which includes a top cushion which can be removed and used in a bottom-up posture as a writing or work surface.

DESCRIPTION OF THE PRIOR ART AND OBJECTIVES OF THE INVENTION

Footstools, ottomans and the like have been used for many years to provide comfort and utility for the user. Past footstools often have hinged tops which open to reveal a storage space. Other prior footstools are formed from a rigid frame covered with fabric while others have a top cushion which can be removed and used separately from the footstool as needed.

Such prior footstools while useful in certain instances, are generally large and are difficult to transport and store. Some prior ottomans include complex, expensive mechanisms for cushion removal. Other prior art footstools include permanently affixed fabric coverings, which make cleaning of the covering difficult and time consuming.

Thus, with the limitations and disadvantages of footstools and ottomans used here-to-date, the present invention was conceived and one of its objectives is to provide a footstool of the KD (knock down) type which can be easily shipped from a factory and assembled on site using only simple hand tools.

It is another objective of the present invention to provide a footstool which will allow the user to easily exchange the fabric covering for decoration or maintenance purposes.

It is yet another objective of the present invention to provide a footstool in which the method of use provides for removal of the cushion to expose a convenient storage space therebeneath.

It is still another objective of the present invention to provide a footstool having a removable cushion whereby the cushion can be inverted to a bottom-up posture and be used remotely as a portable desk top or work area.

It is a further objective of the present invention to provide a footstool which allows removal of a stiffener in the cushion which can be placed on frame supports to serve as a rigid table top.

It is also an objective of the present invention to provide an aesthetically appearing, sturdy footstool which is inexpensive to manufacture and purchase.

Various other objectives and advantages of the present invention will become apparent to those skilled in the art as a more detailed description is set forth below.

SUMMARY OF THE INVENTION

The aforesaid and other objectives are realized by providing a footstool having a tubular metal frame of the KD type. The metal frame is assembled using threaded members which can be easily, manually applied to create a rectangular frame with a bottom shelf. A fabric covering slides over the frame and is tied to the corners thereof. The cushion is then placed atop the frame where it rests on supports affixed at each corner of the frame. The cushion includes a stiffener within a bottom pocket for integrity purposes when used in a conventional manner. As needed, the cushion can be removed from the footstool, rotated into a bottom-up posture and while in this inverted position the rigid bottom of the cushion provides a convenient work space for writing or other purposes. The stiffener can be removed from the cushion and placed on the cushion supports as an option. In this manner the footstool becomes a work surface or table with the stiffener becoming a rigid top.

DETAILED DESCRIPTION OF THE PREFERRED EMBODIMENT AND OPERATION OF THE INVENTION

Figure 1:
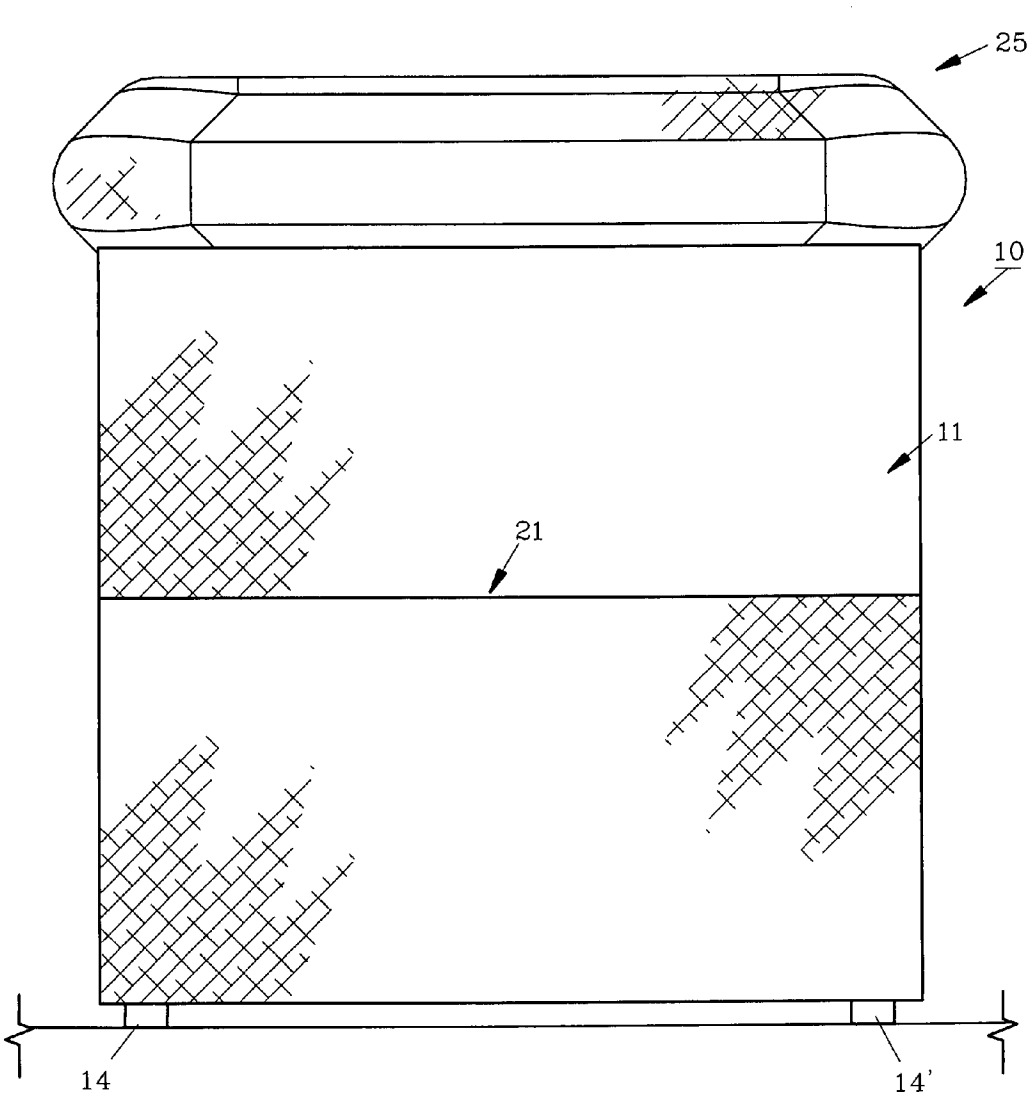
FIG. 1 demonstrates a side elevational view of the preferred footstool of the invention.
Figure 6:
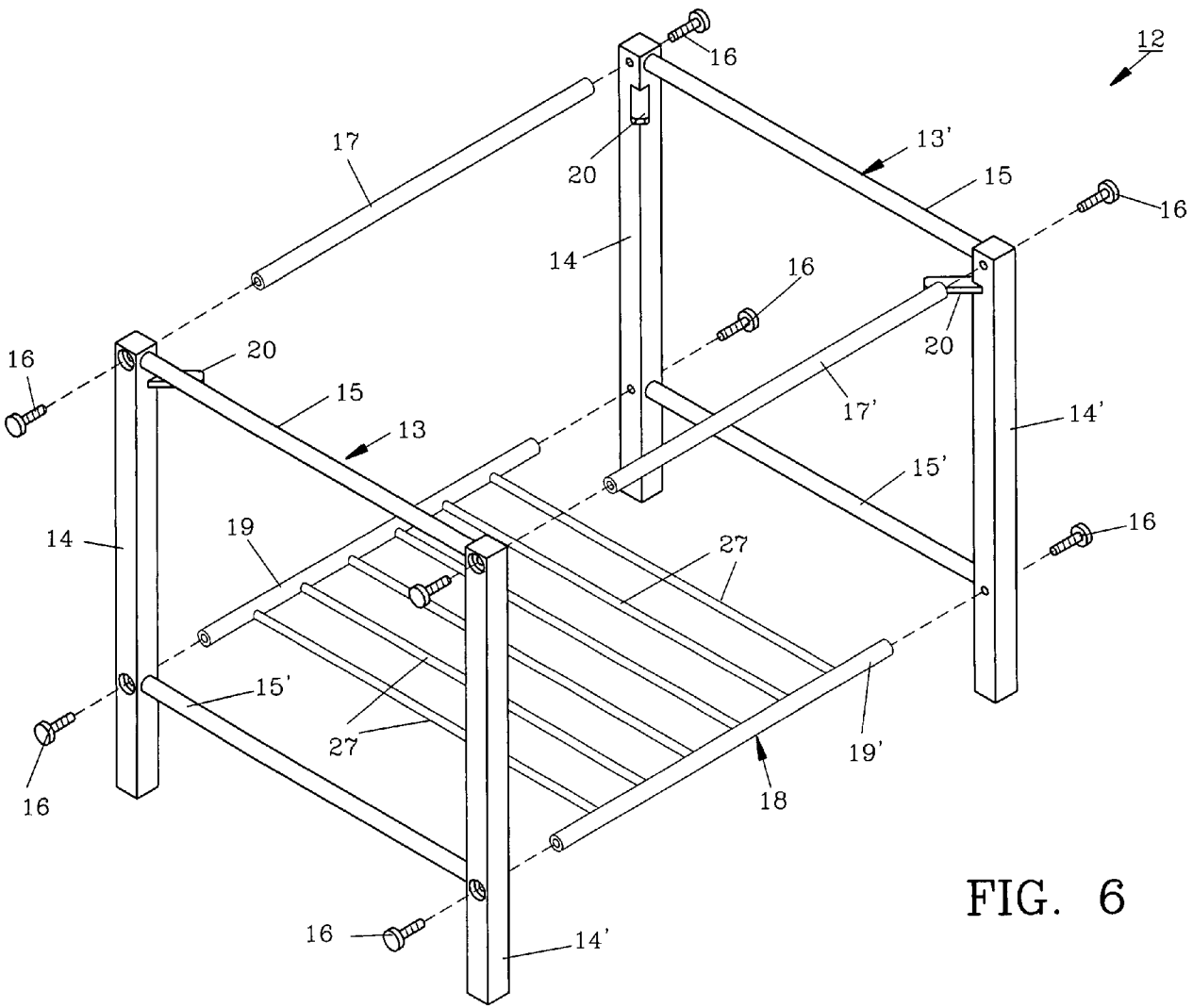
FIG. 6 illustrates the frame of the footstool in an exploded fashion.

For a better understanding of the invention and its operation, turning now to the drawings, FIG. 1 illustrates a side elevational view of preferred footstool 10 with fabric covering 11 positioned over knock down frame 12 seen exploded in FIG. 6. Frame 12 is formed from preferably, metal tubular members and includes rectangular lateral frame ends 13, 13'. Each of tubular lateral members 15, 15' is affixed to rectangular tubular corner members 14, 14' such as by welding, brazing, soldering or the like. Shelf 18 is seen exploded from lower lateral members 15', 15' and includes tubular shelf ends 19, 19' which are each joined to six (6) solid shelf rods 27 having a smaller diameter. Shelf 18 is joined to each corner member 14, 14' by threaded members 16.

As further seen in FIG. 6, threaded members 16 likewise join spacers 17, 17' which are internally threaded to corner members 14, 14' which assist in maintaining frame 12 in a sturdy, rectangular configuration. Each corner member 14, 14' has a cushion support 20 attached thereto for receiving cushion 25 as shown in FIGS. 1 and 3.

Figure 3:
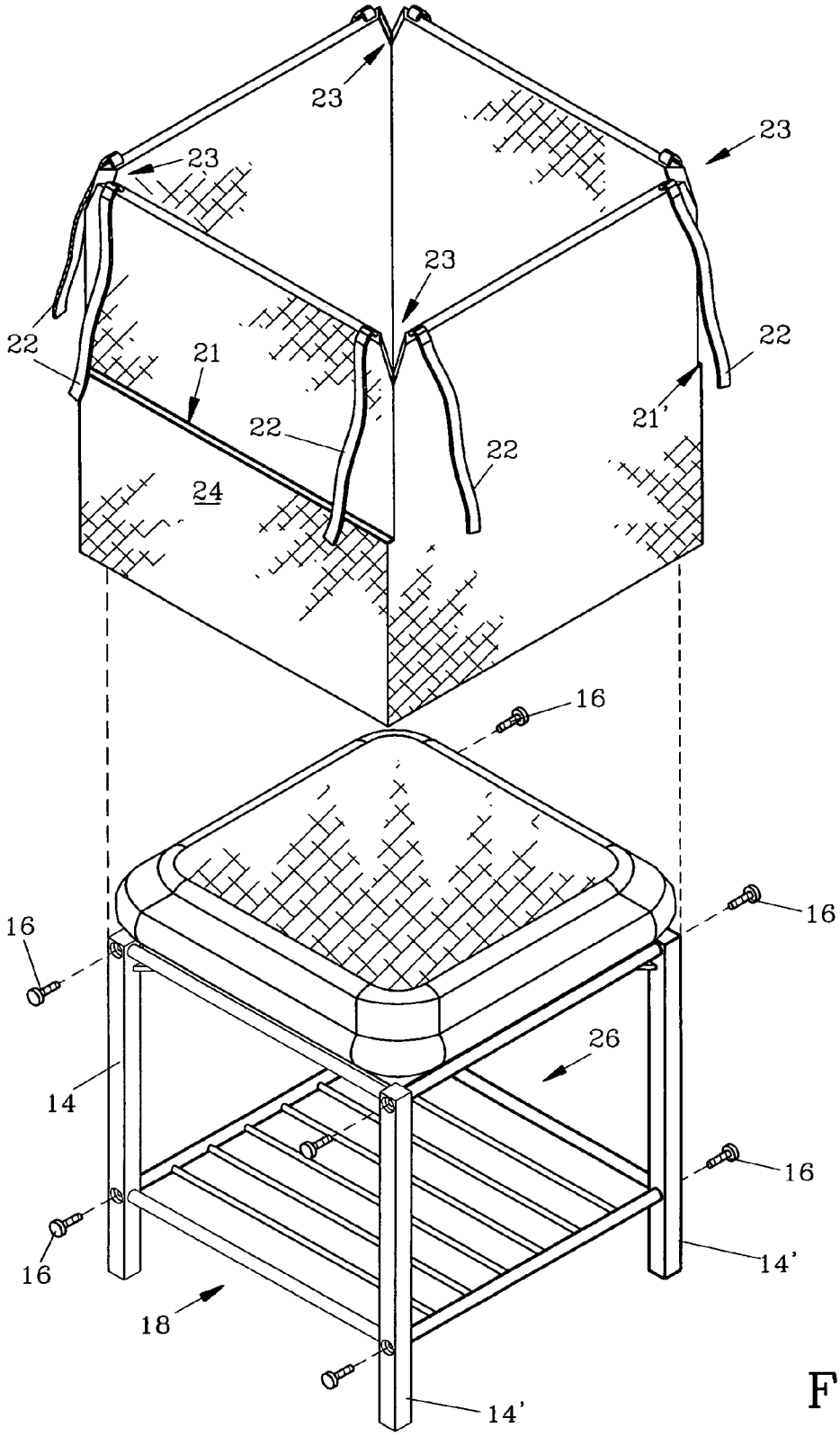
FIG. 3 demonstrates the footstool of FIG. 1 in an exploded, partially disassembled perspective view.

Fabric covering 11 formed from cotton, vinyl, leather or other materials is affixed to frame 12 by tie straps 22 which are sewn or otherwise affixed to the corners of fabric covering 11 as shown in FIG. 3. Fabric covering 11 defines v-shaped notch 23 at each of the upper corners of fabric covering 11. Tie straps 22 are not shown in FIG. 1 as they are tied to corner members 14, 14' beneath spacers 17, 17' and upper lateral members 15, 15 to secure covering 11 on frame 12. Fabric covering 11 also includes a pair of side pockets 24, 24', one on either side as shown in FIG. 3 (pocket 24' not shown). Pockets 24, 24' provide convenient storage space for personal items such as magazines, newspapers or the like placed therein through respectively openings 21, 21'.

Figure 2:
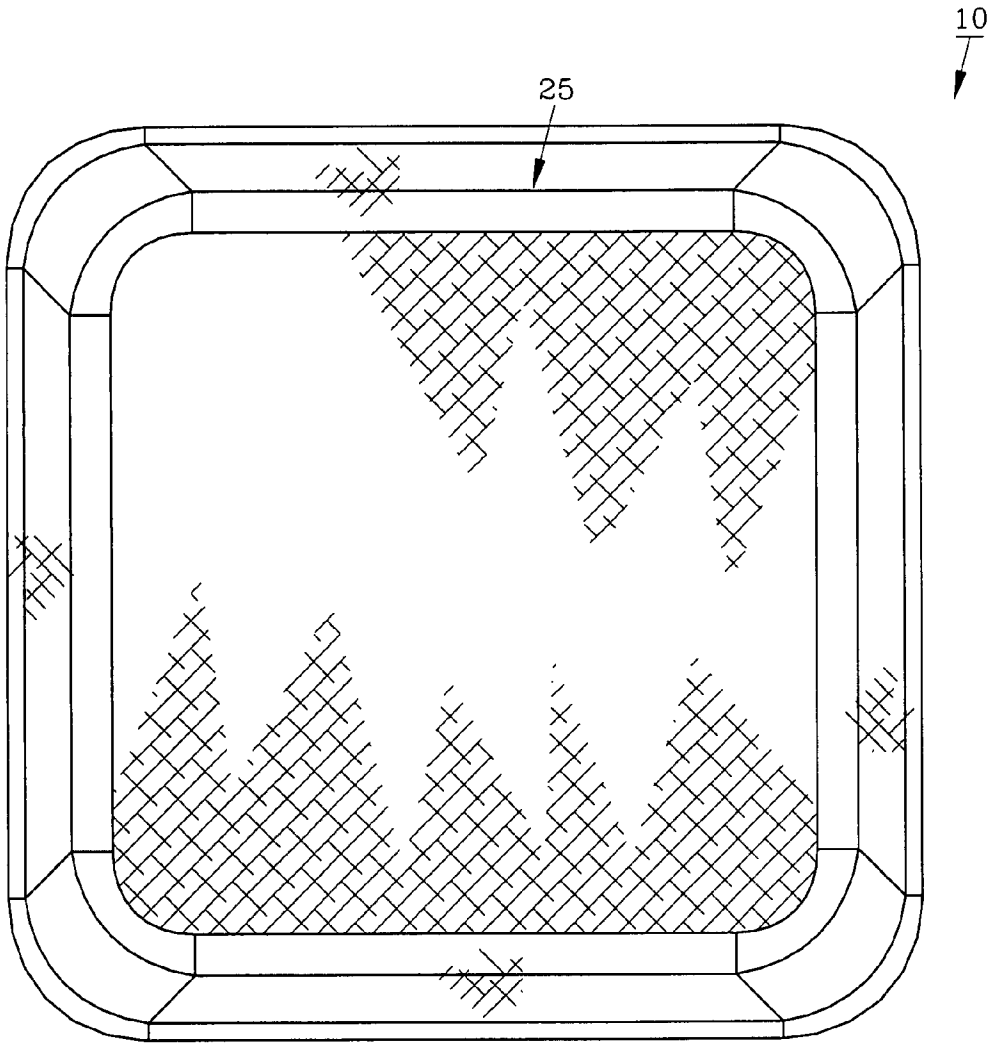
FIG. 2 shows a top plan view of the footstool as shown in FIG. 1.

Once frame 12 has been fully assembled as shown in FIG. 3 (threaded members 16 shown removed), fabric covering 11 can be for example, unfolded from its shipping container and placed over frame 12. As seen in FIG. 3, storage compartment 26 is provided beneath cushion 25. With fabric covering 11 in place on frame 12 and tie straps 22 secured around corner members 14, 14', cushion 25 as seen in FIG. 2 can then be placed thereon. Upon removal of cushion 25 from frame 12, storage compartment 26 is revealed whereby shelf 18 can be utilized for storage purposes.

Figure 4:
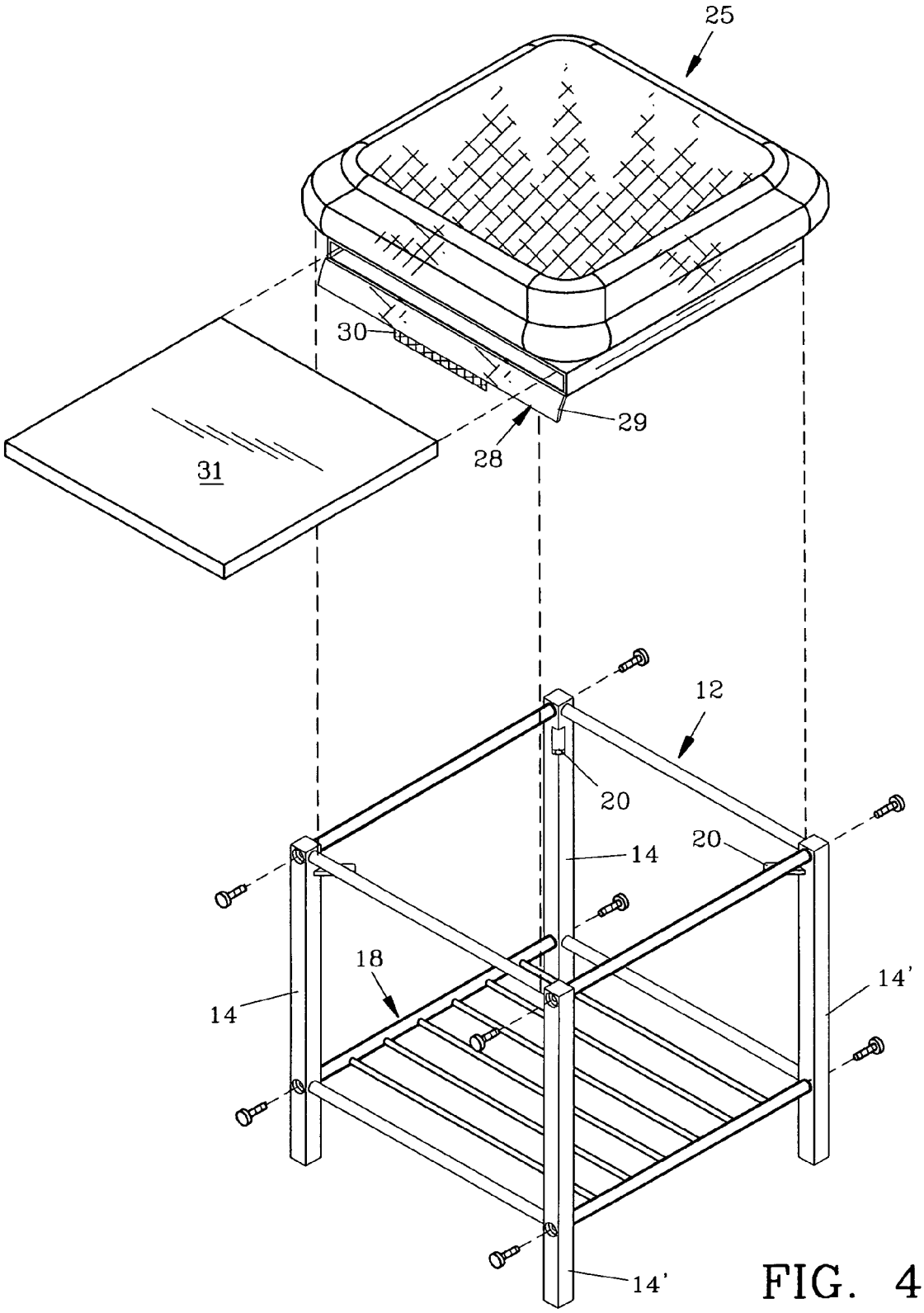
FIG. 4 illustrates a partial exploded view of the footstool as shown in FIG. 3 with the stiffener removed from the cushion bottom.
Figure 5:
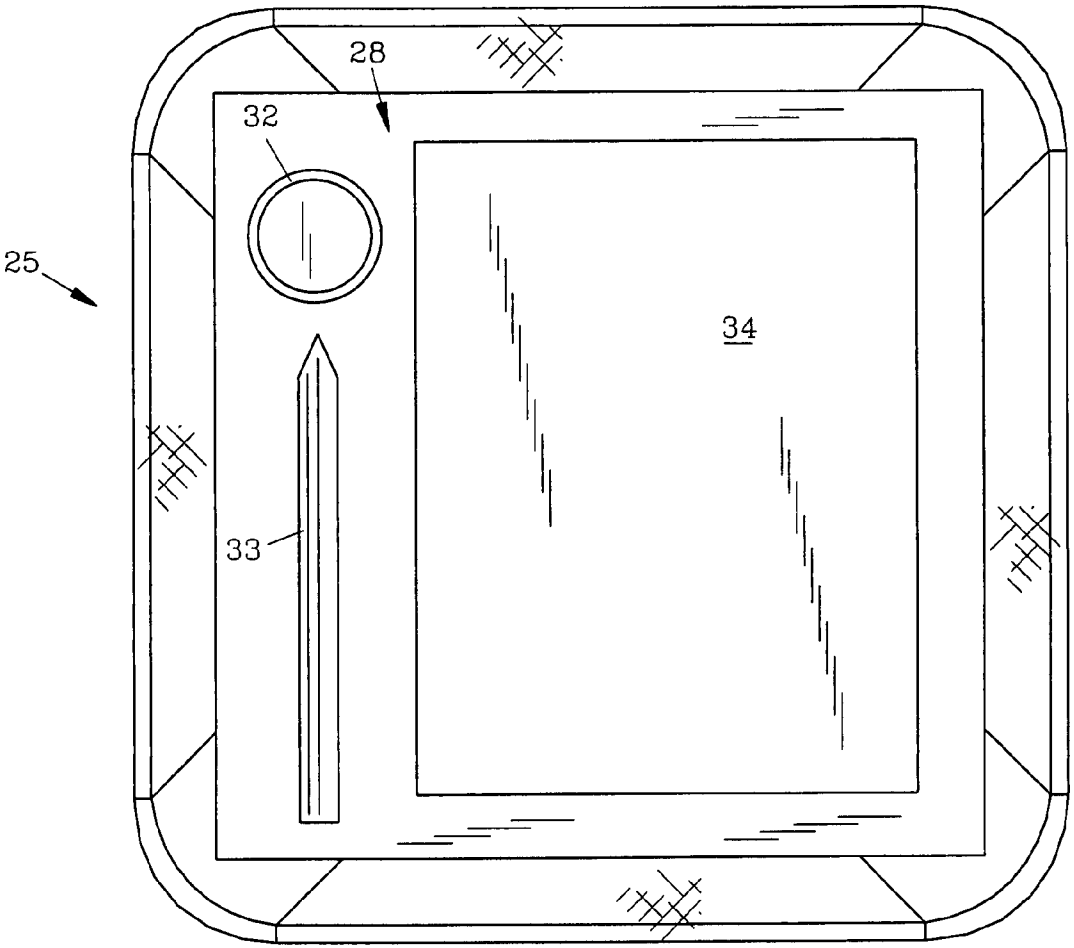
FIG. 5 shows a top plan view of the cushion in a bottom-up posture.
Figure 7:
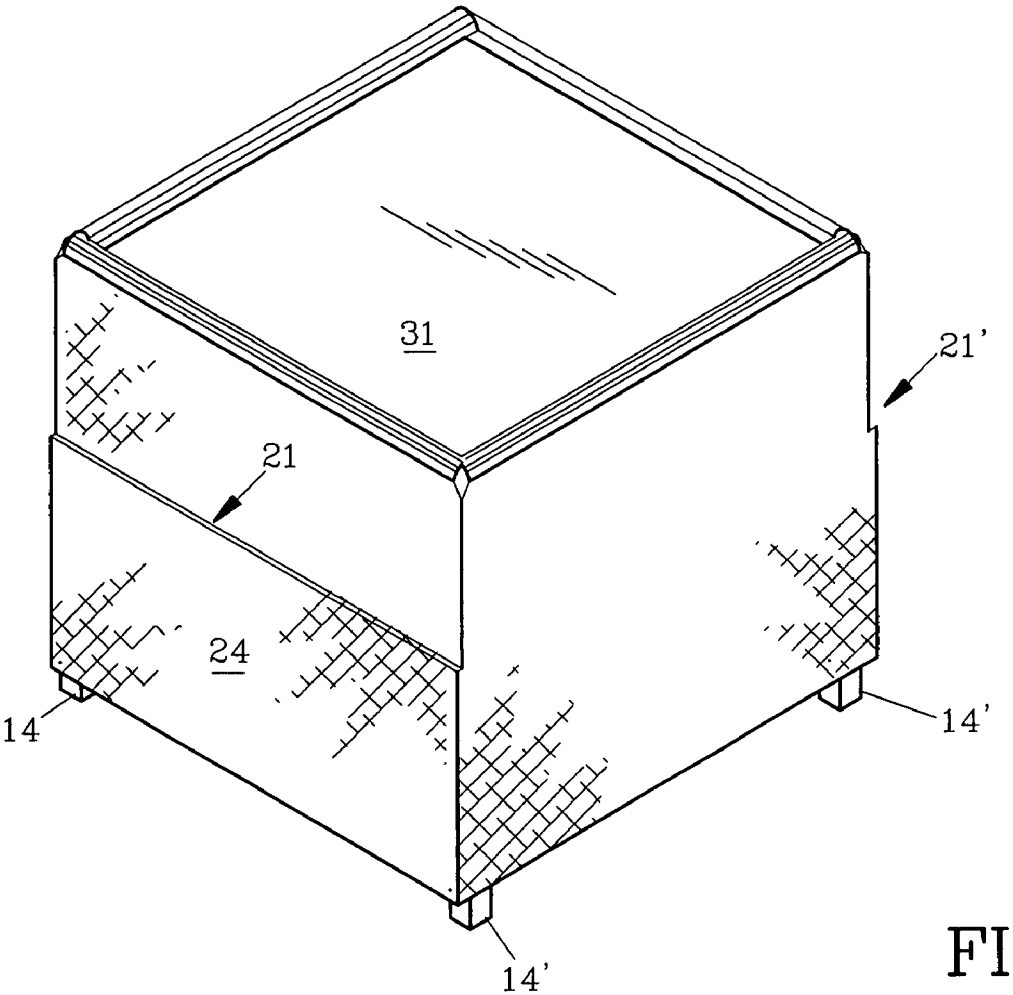
FIG. 7 depicts the stiffener removed from the cushion and resting in the footstool to serve as a table.

In FIG. 4, cushion supports 20 are rigidly affixed to corner members 14, 14' and support the bottom of cushion 25 as shown for example, in FIG. 3. Cushion 25 includes stiffener pocket 28 as seen in FIG. 4 for placement of stiffener 31 therein. Stiffener pocket 28 includes flap 29 having hook and loop fastener 30 to maintain flap 29 in a closed posture as needed. While hook and loop fastener 30 is preferred, other types of fasteners could be used such as buttons, snaps, zippers or the like. Stiffener 31 has a planar, rectangular shape and may consist of wood, metal, masonite, plastic or other suitable rigid materials. Stiffener 31, once inside pocket 28 presents a rigid base for cushion 25 as it rests on cushion supports 20. Cushion 25 can be removed from frame 12, inverted to a bottom-up posture as seen in FIG. 5 and placed on the user's lap, bed or otherwise whereby stiffener 31 will maintain drinking glass 32, pencil 33, or paper sheet 34 thereon in a stable manner. Stiffener 31 can also be removed from cushion 25 and placed on cushion supports 20 for use as a table top as seen in FIG. 7.

The method of use for footstool 10 comprises first manually assembling frame 12 with threaded members 16 as illustrated in FIG. 6. Once frame 12 is suitably assembled fabric covering 11 is placed over frame 12 and tie straps 22 are secured at each corner of frame 12. Next, stiffener 31 is inserted into pocket 28 and flap 29 can then be closed and cushion 25 placed atop frame 12. Footstool 10 can then be used in a conventional manner. For storage purposes, cushion 25 is removed revealing storage compartment 26 for maintaining books, toys or the like in a concealed manner. As desired, cushion 25 can be removed and inverted to be used on a chair, bed or otherwise as a rigid work surface.

The illustrations and examples provided herein are for explanatory purposes and are not intended to limit the scope of the appended claims.

What is claimed is:

1. A footstool comprising: a frame, said frame comprising a pair of opposing ends, a pair of spacers, said spacers positioned between said ends, a shelf, said shelf attached to said ends below said spacers, a plurality of threaded members, said threaded members attached to said ends to releasably affix said spacers and said shelf thereto, a frame covering, said frame covering positioned on said frame, said frame covering defining a notch, a tie strap, said tie strap attached to said frame covering proximate said notch, said tie strap for securing said frame covering to said frame, a cushion support, said cushion support attached to one of said ends, a reversible cushion, said cushion positioned on said frame, said cushion defining a top and a bottom, said bottom defining a flat surface for supporting items thereon when said cushion is positioned bottom up, said frame, said frame covering and said cushion defining a storage compartment.

2. The footstool of claim 1 wherein said cushion support is attached to said frame to engage said cushion bottom.

3. The footstool of claim 1 wherein said cushion defines a pocket, said pocket proximate said bottom, a stiffener, said stiffener positioned within said pocket.

4. The footstool of claim 1 wherein said frame covering comprises a fabric tube, a plurality of tie straps, each of said tie straps attached to said fabric tube proximate said notch.

5. The footstool of claim 1 wherein said frame is formed from metal.

6. A footstool comprising: a rectangular frame, a fabric frame covering, said fabric covering comprises a tube, said tube defining a notch, said fabric covering positioned over said frame, a cushion, said cushion positioned on said frame, said cushion defining a top and a bottom, a pocket, said pocket attached to said bottom, a stiffener, said stiffener contained within said pocket, and a cushion support, said cushion rest support attached to said frame.

7. The footstool of claim 6 further comprising a shelf, said shelf affixed to said frame below said cushion support, said shelf comprising a pair of tubular members, a plurality of rods, said rods attached to said tubular members therebetween, said shelf, said frame covering and said cushion defining a concealed storage compartment.

8. The footstool of claim 1 wherein said frame is rectangular and said notch is V-shaped.

9. The footstool of claim 6 further comprising a pair of tie straps, each of said tie straps attached to said frame covering on opposite sides of said notch for securing said frame covering to said frame.

10. The footstool of claim 9 wherein said pocket is positioned on the exterior of said frame covering.

* * * * *